US011369139B2

(12) United States Patent
An et al.

(10) Patent No.: US 11,369,139 B2
(45) Date of Patent: Jun. 28, 2022

(54) AEROSOL GENERATING DEVICE

(71) Applicant: KT&G CORPORATION, Daejeon (KR)

(72) Inventors: Hwi Kyeong An, Seoul (KR); Kyung Moon Ji, Anyang-si (KR); In Seoung Chun, Goyang-si (KR); Won Hui Shin, Seongnam-si (KR)

(73) Assignee: KT&G CORPORATION, Daejeon (KR)

( * ) Notice: Subject to any disclaimer, the term of this patent is extended or adjusted under 35 U.S.C. 154(b) by 0 days.

(21) Appl. No.: 16/943,780

(22) Filed: Jul. 30, 2020

(65) Prior Publication Data

US 2020/0352230 A1 Nov. 12, 2020

Related U.S. Application Data

(63) Continuation of application No. 16/644,598, filed as application No. PCT/KR2019/000874 on Jan. 22, 2019.

(30) Foreign Application Priority Data

Jun. 5, 2018 (KR) ..... 10-2018-0064915

(51) Int. Cl.
*A24F 40/20* (2020.01)
*A24F 40/40* (2020.01)

(52) U.S. Cl.
CPC ..... *A24F 40/20* (2020.01); *A24F 40/40* (2020.01)

(58) Field of Classification Search
CPC ..... A24F 40/20; A24F 40/40; A24F 40/46; A24F 15/00; A24F 15/01; A24F 15/015; A61M 15/06
See application file for complete search history.

(56) References Cited

U.S. PATENT DOCUMENTS

| | | | |
|---|---|---|---|
| 6,026,820 | A | 2/2000 | Baggett, Jr. et al. |
| 6,053,176 | A | 4/2000 | Adams et al. |
| 7,562,915 | B2 | 6/2009 | Chen |
| 8,833,364 | B2 | 9/2014 | Buchberger |
| 9,710,019 | B2 | 7/2017 | Kwon et al. |

(Continued)

FOREIGN PATENT DOCUMENTS

| | | | |
|---|---|---|---|
| CN | 203388273 | U | 1/2014 |
| CN | 205180371 | U | 4/2016 |

(Continued)

OTHER PUBLICATIONS

CN207411489 (Machine Translation) [online], [retrieved on May 10, 2021], retrieved from ESPACENET (https://worldwide.espacenet.com/) (Year: 2018).*

(Continued)

*Primary Examiner* — Michael J Felton
*Assistant Examiner* — Yana B Krinker
(74) *Attorney, Agent, or Firm* — Sughrue Mion, PLLC

(57) ABSTRACT

Provided is an aerosol generating device including a case in which a heater for heating a cigarette is installed, a bracket for supporting components installed inside the case, a fastening member for fastening the case and the bracket, and a cap that is installed on an outer surface of the case in an inseparable manner to conceal the fastening member in the case.

3 Claims, 7 Drawing Sheets

(56) References Cited

U.S. PATENT DOCUMENTS

| | | | | |
|---|---|---|---|---|
| 9,826,779 | B2 | 11/2017 | Hearn et al. | |
| 10,079,376 | B2 | 9/2018 | Cho et al. | |
| 10,271,443 | B2 | 4/2019 | Kajiura et al. | |
| 10,543,323 | B2 | 1/2020 | Buchberger | |
| 2004/0089314 | A1 | 5/2004 | Felter et al. | |
| 2011/0226236 | A1 | 9/2011 | Buchberger | |
| 2012/0031905 | A1 | 2/2012 | Perez et al. | |
| 2014/0299125 | A1 | 10/2014 | Buchberger | |
| 2015/0245657 | A1 | 9/2015 | Memari et al. | |
| 2015/0342258 | A1* | 12/2015 | Chen | H05B 3/06 131/329 |
| 2017/0042215 | A1 | 2/2017 | Murison | |
| 2017/0208865 | A1 | 7/2017 | Nettenstrom et al. | |
| 2019/0166914 | A1 | 6/2019 | Qiu | |
| 2019/0320719 | A1 | 10/2019 | Liu et al. | |
| 2019/0364975 | A1 | 12/2019 | Fernando et al. | |
| 2020/0154766 | A1 | 5/2020 | Jeong | |
| 2020/0187555 | A1 | 6/2020 | Lee | |
| 2021/0059300 | A1* | 3/2021 | An | A24F 40/40 |

FOREIGN PATENT DOCUMENTS

| | | | | |
|---|---|---|---|---|
| CN | 105831812 | A | 8/2016 | |
| CN | 105919162 | A | 9/2016 | |
| CN | 107713019 | A | 2/2018 | |
| CN | 207411489 | U | 5/2018 | |
| EP | 3 078 283 | A1 | 10/2016 | |
| GB | 2524736 | A | 10/2015 | |
| JP | 2007242681 | A | 9/2007 | |
| JP | 2014-216287 | A | 11/2014 | |
| JP | 2015-13192 | A | 1/2015 | |
| JP | 2016-519574 | A | 7/2016 | |
| KR | 1019990019863 | U | 11/1997 | |
| KR | 20-2009-0004044 | U | 4/2009 | |
| KR | 101324667 | B1 | 5/2011 | |
| KR | 1020150000774 | A | 1/2015 | |
| KR | 1020160009890 | A | 1/2016 | |
| KR | 10-1631286 | B1 | 6/2016 | |
| KR | 10-2017-0125370 | A | 11/2017 | |
| KR | 10-2018-0023621 | A | 3/2018 | |
| KR | 10-2018-0070453 | A1 | 6/2018 | |
| KR | 10-2018-0129676 | A1 | 12/2018 | |
| KR | 10-2019-0010216 | A | 1/2019 | |
| RU | 2527351 | C2 | 8/2014 | |
| RU | 2531890 | C2 | 10/2014 | |
| RU | 2550320 | C2 | 5/2015 | |
| WO | WO-2004022128 | A2 * | 3/2004 | A61P 5/00 |
| WO | 2015/174657 | A1 | 11/2015 | |
| WO | 2017115277 | A1 | 7/2017 | |
| WO | 2017/194764 | A1 | 11/2017 | |
| WO | 2018/014817 | A1 | 1/2018 | |
| WO | WO-2019235711 | A1 * | 12/2019 | A24F 40/20 |

OTHER PUBLICATIONS

Communication dated Mar. 9, 2021, from the Japanese Patent Office in Application No. 2020-520105.

Communication dated Feb. 11, 2021, from the Russian Federal Service for Intellectual Property in Application No. 2020114379.

Communication dated Feb. 2, 2021, from the Russian Federal Service for Intellectual Property in Application No. 2020124809.

Communication dated Jul. 10, 2019, issued by the Korean Intellectual Property Office in Korean Application No. 10-2018-0064486.

International Search Report in International Application No. PCT/KR2019/002638, dated Jun. 12, 2019.

Notice of Allowance issued in the Korean Patent Office dated Jun. 26, 2019 in corresponding Korean Application No. 10-2019-0021969.

Extended European Search Report dated Apr. 19, 2021 in European Application No. 20188794.0.

Office Action dated Aug. 11, 2021 in Canadian Application No. 3,084,075.

Office Action dated Mar. 16, 2022, issued in Chinese Application No. 201980004686.2.

Extended European Search Report dated Feb. 25, 2022, issued in European Application No. 19815124.3.

* cited by examiner

AEROSOL GENERATING DEVICE

This application is a continuation of U.S. application Ser. No. 16/644,598 filed on Mar. 5, 2020, which is a National Stage of International Application No. PCT/KR2019/000874 filed Jan. 22, 2019, claiming priority based on Korean Patent Application No. 10-2018-0064915, filed Jun. 5, 2018.

TECHNICAL FIELD

One or more exemplary embodiments of the present disclosure relate to an aerosol generating device, and more particularly, to an aerosol generating device having a structure that a user is unable to disassemble arbitrarily.

BACKGROUND ART

Recently, the demand for alternative methods to overcome the shortcomings of general cigarettes has increased. For example, there is an increasing demand for a method of generating aerosol by heating an aerosol generating material in cigarettes, rather than by burning cigarettes. Accordingly, studies on a heating-type cigarette or a heating-type aerosol generating device have been actively conducted.

A non-combustion aerosol generating device refers to an apparatus which generates aerosols from an aerosol generating material included in a cigarette by heating the cigarette to a certain temperature without burning the cigarette, and allows a user to inhale the generated aerosols with air.

The non-combustion aerosol generating device is provided with a heater for heating the cigarette therein. Since the heater is heated to a high temperature, when the user disassembles the apparatus arbitrarily, the user may be easily exposed to a risk of being burned.

It is to be appreciated that the above-described background art is technical information kept by the inventors to obtain exemplary embodiments of the present disclosure or acquired by the inventors in the process of obtaining the exemplary embodiments, thus the background art may not have been known to the general public before the application of the exemplary embodiments of the present disclosure.

DESCRIPTION OF EXEMPLARY EMBODIMENTS

Technical Problem

One or more exemplary embodiments of the present disclosure provide an aerosol generating device having a structure that a user is unable to disassemble arbitrarily.

In addition, one or more exemplary embodiments of the present disclosure may provide aerosols containing rich flavors, nicotine, and the like by passing the aerosols generated by heating an aerosol generating source through a cigarette.

Solution to Problem

An exemplary embodiment of the present disclosure provides an aerosol generating device including: a case in which a heater for heating a cigarette is installed; a bracket for supporting components installed inside the case; a fastening member for fastening the case and the bracket; and a cap that is installed on an outer surface of the case in an inseparable manner to conceal the fastening member in the case.

In an exemplary embodiment, the cap includes a hook portion protruding in the lengthwise direction of the cigarette, wherein the hook portion may include a locking jaw protruding toward the inner surface of the case.

In an exemplary embodiment, the case may include a seating portion protruding toward the hook portion to seat the cap.

In an exemplary embodiment, when the cap is installed in the case, the seating portion may be engaged with the locking jaw, thus restricting upward movement of the cap upward.

In an exemplary embodiment, the surface where the seating portion and the locking jaw contact each other may be extended in a direction parallel to the width direction of the cigarette.

In an exemplary embodiment, the aerosol generating device may further include a stopper that is installed on the inner surface of the case, presses the hook portion in the direction in which the locking jaw protrudes, and thus restricts movement of the hook portion in the direction in which the seating portion protrudes.

In an exemplary embodiment, the locking jaw may include an inclined surface such that the seating portion slides on the inclined surface while the cap is being installed in the case.

In an exemplary embodiment, the seating portion may include a sliding surface such that the locking jaw slides on the sliding surface while the cap is being installed in the case.

In an exemplary embodiment, the aerosol generating device may further include a sealing member interposed between the case and the cap to seal the inside of the case.

In an exemplary embodiment, the case includes an upper case where the cigarette is inserted and heated and a lower case supporting and protecting various components installed therein, wherein the contact surfaces of the upper case and the cap, and of the upper case and the lower case may be joined by ultrasonic welding.

In an exemplary embodiment, the hook portion further includes an extension member extending in the lengthwise direction of the cigarette further than the locking jaw, and the stopper may press the extension member in the direction in which the locking jaw protrudes.

In an exemplary embodiment, along the lengthwise direction of the cigarette, the length of the extension member may be greater than the distance from the stopper to the surface where the seating portion and the cap contact each other.

In an exemplary embodiment, along the lengthwise direction of the cigarette, the width of the locking jaw may be less than or equal to the distance from the surface where the locking jaw and the seating portion engage with each other to the stopper.

In an exemplary embodiment, along the width direction of the cigarette, the width of the hook portion excluding the locking jaw may be less than the distance from the stopper to the locking jaw.

In the present an exemplary embodiment, along the width direction of the cigarette, the width of the hook portion including the locking jaw may be greater than the distance from the stopper to the locking jaw.

It is to be appreciated that the present disclosure is not limited to the above-described exemplary embodiments, and other features and advantages of the exemplary embodiments will be more fully understood from the following detailed description taken in conjunction with the accompanying drawings, without departing from the true scope and spirit of the appended claims.

Advantageous Effects of Disclosure

As described above, one or more exemplary embodiments of the present disclosure may provide an aerosol generating device having a structure that a user is unable to disassemble arbitrarily since the user is unable to have access to a fastening member installed in a case due to an inseparable coupling structure of the case and cap.

In addition, the aerosol generating device may provide aerosols containing flavors, nicotine, and the like suitable for the user by passing the flow of the aerosols generated from an aerosol generating source through a cigarette.

BEST MODE

An exemplary embodiment of the present disclosure provides an aerosol generating device including: a case in which a heater for heating a cigarette is installed; a bracket for supporting components installed in the case; a fastening member for fastening the case and the bracket; and a cap that is installed on the outer surface of the case to conceal the fastening member in the case, and inseparable after installation.

MODE OF DISCLOSURE

With respect to the terms in the various exemplary embodiments, the general terms which are currently and widely used are selected in consideration of functions of structural elements in the various exemplary embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various exemplary embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the exemplary embodiments set forth herein.

Hereinafter, exemplary embodiments of the present disclosure will be described in detail with reference to the drawings.

Figure 1:
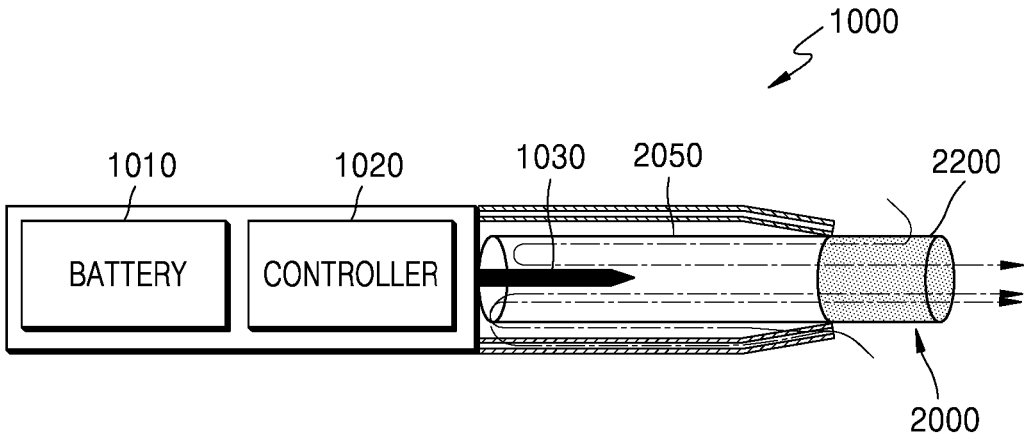
FIGS. 1 through 3 are diagrams showing examples in which a cigarette is inserted into an aerosol generating device.
Figure 2:
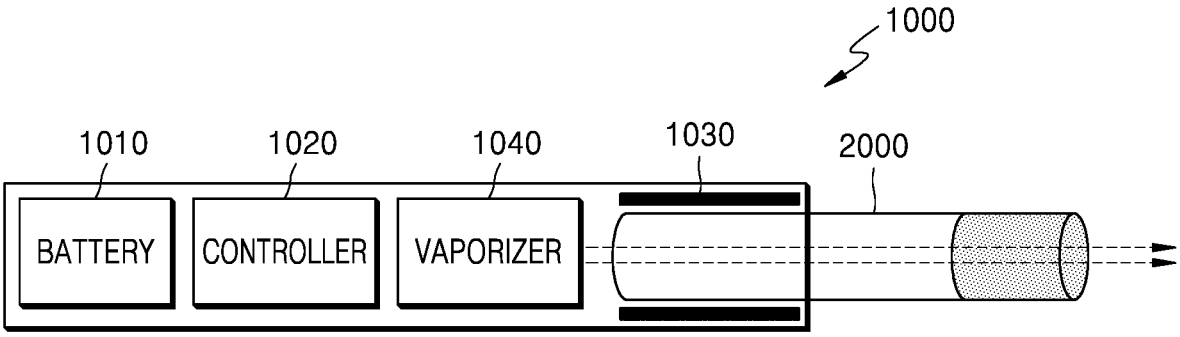
Figure 3:
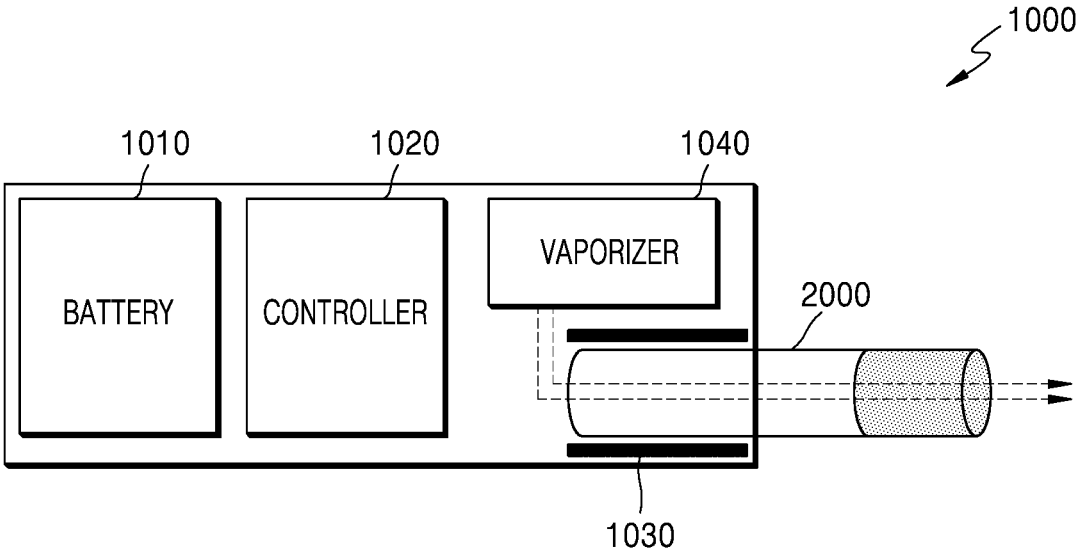

FIGS. 1 through 3 are diagrams showing examples in which a cigarette is inserted into an aerosol generating device.

Referring to FIG. 1, the aerosol generating device 1000 may include a battery 1010, a controller 1020, and a heater 1030. Referring to FIGS. 2 and 3, the aerosol generating device 1000 may further include a vaporizer 1040. Also, the cigarette 2000 may be inserted into an inner space of the aerosol generating device 1000.

FIGS. 1 through 3 illustrate components of the aerosol generating device 1000, which are related to the present embodiment. Therefore, it will be understood by one of ordinary skill in the art related to the present embodiment that other general-purpose components may be further included in the aerosol generating device 1000, in addition to the components illustrated in FIGS. 1 through 3.

Also, FIGS. 2 and 3 illustrate the aerosol generating device 1000 including the heater 1030. However, according to necessity, the heater 1030 may be omitted.

FIG. 1 illustrates that the battery 1010, the controller 1020, and the heater 1030 are arranged in series. Also, FIG. 2 illustrates that the battery 1010, the controller 1020, the vaporizer 1040, and the heater 1030 are arranged in series. Also, FIG. 3 illustrates that the vaporizer 1040 and the heater 1030 are arranged in parallel. However, the internal structure of the aerosol generating device 1000 is not limited to the structures illustrated in FIGS. 1 through 3. In other words, according to the design of the aerosol generating device 1000, the battery 1010, the controller 1020, the heater 1030, and the vaporizer 1040 may be differently arranged.

When the cigarette 2000 is inserted into the aerosol generating device 1000, the aerosol generating device 1000 may operate the heater 1030 and/or the vaporizer 1040 to generate an aerosol from the cigarette 2000 and/or the vaporizer 1040. The aerosol generated by the heater 1030 and/or the vaporizer 1040 is delivered to a user by passing through the cigarette 2000.

According to necessity, even when the cigarette 2000 is not inserted into the aerosol generating device 1000, the aerosol generating device 1000 may heat the heater 1030.

The battery 1010 may supply power to be used for the aerosol generating device 1000 to operate. For example, the battery 1010 may supply power to heat the heater 1030 or the vaporizer 1040, and may supply power for operating the controller 1020. Also, the battery 1010 may supply power for operations of a display, a sensor, a motor, etc. mounted in the aerosol generating device 1000.

The controller 1020 may generally control operations of the aerosol generating device 1000. In detail, the controller 1020 may control not only operations of the battery 1010, the heater 1030, and the vaporizer 1040, but also operations of other components included in the aerosol generating device 1000. Also, the controller 1020 may check a state of each of the components of the aerosol generating device 1000 to determine whether or not the aerosol generating device 1000 is able to operate.

The controller 1020 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 1030 may be heated by the power supplied from the battery 1010. For example, when the cigarette 2000 is inserted into the aerosol generating device 1000, the heater 1030 may be located outside the cigarette 2000. Thus, the heated heater 1030 may increase a temperature of an aerosol generating material in the cigarette 2000.

The heater 1030 may include an electro-resistive heater. For example, the heater 1030 may include an electrically conductive track, and the heater 1030 may be heated when currents flow through the electrically conductive track. However, the heater 1030 is not limited to the example described above and may include all heaters which may be heated to a desired temperature. Here, the desired temperature may be pre-set in the aerosol generating device 1000 or may be set as a temperature desired by a user.

As another example, the heater 1030 may include an induction heater. In detail, the heater 1030 may include an electrically conductive coil for heating a cigarette in an induction heating method, and the cigarette may include a susceptor which may be heated by the induction heater.

For example, the heater 1030 may include a tube-type heating element, a plate-type heating element, a needle-type heating element, or a rod-type heating element, and may heat the inside or the outside of the cigarette 2000, according to the shape of the heating element.

Also, the aerosol generating device 1000 may include a plurality of heaters 1030. Here, the plurality of heaters 1030 may be inserted into the cigarette 2000 or may be arranged outside the cigarette 2000. Also, some of the plurality of heaters 1030 may be inserted into the cigarette 2000 and the others may be arranged outside the cigarette 2000. In addition, the shape of the heater 1030 is not limited to the shapes illustrated in FIGS. 1 through 3 and may include various shapes.

The vaporizer 1040 may generate an aerosol by heating a liquid composition and the generated aerosol may pass through the cigarette 2000 to be delivered to a user. In other words, the aerosol generated via the vaporizer 1040 may move along an air flow passage of the aerosol generating device 1000 and the air flow passage may be configured such that the aerosol generated via the vaporizer 1040 passes through the cigarette 2000 to be delivered to the user.

For example, the vaporizer 1040 may include a liquid storage, a liquid delivery element, and a heating element, but it is not limited thereto. For example, the liquid storage, the liquid delivery element, and the heating element may be included in the aerosol generating device 1000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 1040 or may be formed integrally with the vaporizer 1040.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 1040 may be referred to as a cartomizer or an atomizer, but it is not limited thereto.

The aerosol generating device 1000 may further include general-purpose components in addition to the battery 1010, the controller 1020, the heater 1030, and the vaporizer 1040. For example, the aerosol generating device 1000 may include a display capable of outputting visual information and/or a motor for outputting haptic information. Also, the aerosol generating device 1000 may include at least one sensor (a puff detecting sensor, a temperature detecting sensor, a cigarette insertion detecting sensor, etc.). Also, the aerosol generating device 1000 may be formed as a structure where, even when the cigarette 2000 is inserted into the aerosol generating device 1000, external air may be introduced or internal air may be discharged.

Although not illustrated in FIGS. 1 through 3, the aerosol generating device 1000 and an additional cradle may form together a system. For example, the cradle may be used to charge the battery 1010 of the aerosol generating device 1000. Alternatively, the heater 1030 may be heated when the cradle and the aerosol generating device 1000 are coupled to each other.

The cigarette 2000 may be similar as a general combustive cigarette. For example, the cigarette 2000 may be divided into a first portion including an aerosol generating material and a second portion including a filter, etc. Alternatively, the second portion of the cigarette 2000 may also include an aerosol generating material. For example, an aerosol generating material made in the form of granules or capsules may be inserted into the second portion.

The entire first portion may be inserted into the aerosol generating device 1000, and the second portion may be exposed to the outside. Alternatively, only a portion of the first portion may be inserted into the aerosol generating device 1000. Otherwise, the entire first portion and a portion of the second portion may be inserted into the aerosol generating device 1000. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1000. For example, opening and closing of the air passage and/or a size of the air passage may be adjusted by the user. Accordingly, the amount of smoke and a smoking satisfaction may be adjusted by the user. As another example, the external air may flow into the cigarette 2000 through at least one hole formed in a surface of the cigarette 2000.

Hereinafter, an example of the cigarette 2000 will be described with reference to FIG. 4.

Figure 4:
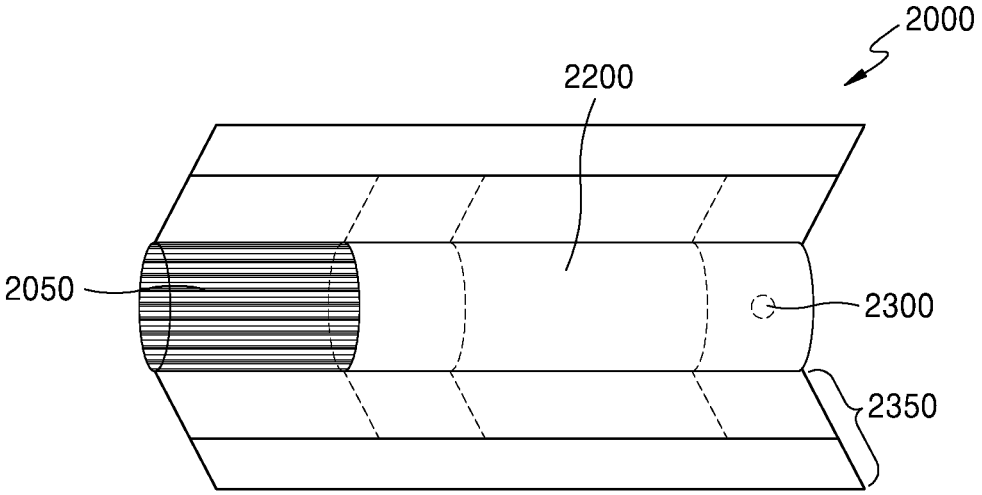
FIG. 4 illustrates an example of the cigarette.

FIG. 4 illustrates an example of a cigarette.

Referring to FIG. 4, the cigarette 2000 may include a tobacco rod 2050 and a filter rod 2200. The first portion described above with reference to FIGS. 1 through 3 may include the tobacco rod 2050, and the second portion may include the filter rod 2200.

FIG. 4 illustrates that the filter rod 2200 includes a single segment. However, the filter rod 2200 is not limited thereto. In other words, the filter rod 2200 may include a plurality of segments. For example, the filter rod 2200 may include a first segment configured to cool aerosol and a second segment configured to filter a certain component included in the aerosol. Also, as necessary, the filter rod 2200 may further include at least one segment configured to perform other functions.

The cigarette 2000 may be packaged using at least one wrapper 2350. The wrapper 2350 may have at least one hole through which external air may be introduced or internal air may be discharged. For example, the cigarette 2000 may be packaged using one wrapper 2350. As another example, the cigarette 2000 may be double-packaged using at least two wrappers 2350. For example, the tobacco rod 2050 may be packaged using a first wrapper, and the filter rod 2200 may be packaged using a second wrapper. Also, the tobacco rod 2050 and the filter rod 2200, which are respectively packaged using separate wrappers, may be coupled to each other, and the entire cigarette 2000 may be packaged using a third wrapper. When each of the tobacco rod 2050 and the filter rod 2200 includes a plurality of segments, each segment may be packaged using a separate wrapper. Also, the entire cigarette 2000 including the plurality of segments, which are respectively packaged using the separate wrappers may be combined and re-packaged together using another wrapper.

The tobacco rod 2050 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 2050 may include other additives, such as flavors, a wetting agent, and/or organic acid. Also, the tobacco rod 2050 may include a flavored liquid, such as menthol or a moisturizer, which is injected to the tobacco rod 2050.

The tobacco rod 2050 may be manufactured in various forms. For example, the tobacco rod 2050 may be formed as a sheet or a strand. Also, the tobacco rod 2050 may be formed as a pipe tobacco, which is formed of tiny bits cut from a tobacco sheet. Also, the tobacco rod 2050 may be surrounded by a heat conductive material. For example, the heat-conducting material may be, but is not limited to, a metal foil such as aluminum foil. For example, the heat conductive material surrounding the tobacco rod 2050 may uniformly distribute heat transmitted to the tobacco rod 2050, and thus, the heat conductivity applied to the tobacco rod may be increased and taste of the tobacco may be improved. Also, the heat conductive material surrounding the tobacco rod 2050 may function as a susceptor heated by the induction heater. Here, although not illustrated in the drawings, the tobacco rod 2050 may further include an additional susceptor, in addition to the heat conductive material surrounding the tobacco rod 2050.

The filter rod 2200 may include a cellulose acetate filter. Shapes of the filter rod 2200 are not limited. For example, the filter rod 2200 may include a cylinder-type rod or a tube-type rod having a hollow inside. Also, the filter rod 2200 may include a recess-type rod. When the filter rod 2200 includes a plurality of segments, at least one of the plurality of segments may have a different shape.

The filter rod 2200 may be formed to generate flavors. For example, a flavoring liquid may be injected onto the filter rod 2200, or an additional fiber coated with a flavoring liquid may be inserted into the filter rod 2200.

Also, the filter rod 2200 may include at least one capsule 2300. Here, the capsule 2300 may generate a flavor or aerosol. For example, the capsule 2300 may have a configuration in which a liquid containing a flavoring material is wrapped with a film. For example, the capsule 2300 may have a spherical or cylindrical shape, but is not limited thereto.

When the filter rod 2200 includes a segment configured to cool the aerosol, the cooling segment may include a polymer material or a biodegradable polymer material. For example, the cooling segment may include pure polylactic acid alone, but the material for forming the cooling segment is not limited thereto. In some exemplary embodiments, the cooling segment may include a cellulose acetate filter having a plurality of holes. However, the cooling segment is not limited to the above-described example and any other cooling segment that is capable of cooling the aerosol may be used.

Although not illustrated in FIG. 4, the cigarette 2000 according to an exemplary embodiment may further include a front-end filter. The front-end filter may be located on a side of the tobacco rod 2050, which is the side not facing the filter rod 2200. The front-end filter may prevent the tobacco rod 2050 from being detached outwards and prevent the liquefied aerosol from flowing into the aerosol generating device 1000 (FIGS. 1 through 3) from the tobacco rod 2050, during smoking.

Figure 5:
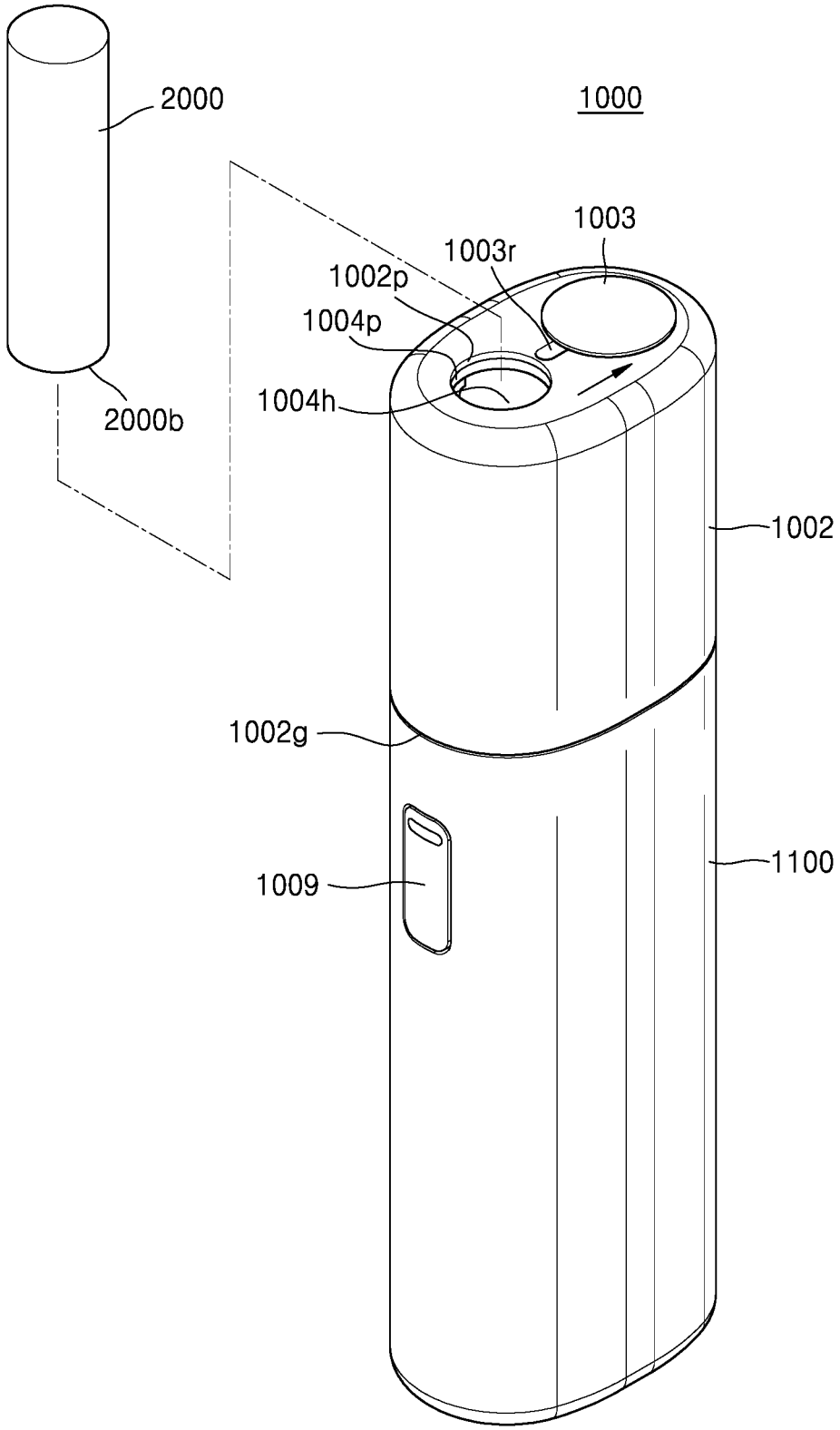
FIG. 5 is a perspective view illustrating an operating state of the aerosol generating device according to an exemplary embodiment.

FIG. 5 is a perspective view illustrating an operating state of the aerosol generating device according to an exemplary embodiment.

The aerosol generating device 1000 according to the exemplary embodiments shown in FIG. 5 may include a casing 1100 and a cover 1002. The cover 1002 is coupled with a first end of the casing 1100, and thus the cover 1002 forms the outer appearance of the aerosol generating device 1000 together with the casing 1100.

The casing 1100 forms the outer appearance of the aerosol generating device 1000 and functions to accommodate and protect various components in a space formed therein.

The cover 1002 and the casing 1100 may include a plastic material with low heat conductivity or a metal coated with a heat barrier material on its surface. The cover 1002 and the casing 1100 may be fabricated through, for example, an injection molding method, a 3D printing method, or a method of assembling small parts fabricated through injection molding.

A maintaining device may be installed between the cover 1002 and the casing 1100 to maintain the coupling of the cover 1002 and the casing 1100. The maintaining device may include, for example, a protrusion and a groove. The coupling of the cover 1002 and the casing 1100 may be maintained by maintaining a state that protrusion is inserted in the groove. The protrusion may be moved by a manipulation button that may be pressed by a user and separated from the groove.

The maintaining device may also include, for example, a magnet and a metal member that sticks to the magnet. When a magnet is used for the maintaining device, a magnet may be installed on either the cover 1002 or the casing 1100, and a metal that sticks to the magnet may be attached to the other one. Alternatively, magnets may be installed on both the cover 1002 and the casing 1100.

In the aerosol generating device 1000 according to the exemplary embodiment shown in FIG. 5, the cover 1002 may be omitted as necessary.

An outside hole 1002*p* through which the cigarette 2000 may be inserted is formed on the top surface of the cover 1002 coupled with the casing 1100. Also, a rail 1003*r* is formed on the top surface of the cover 1002 at a position adjacent to the outside hole 1002*p*. A door 1003 slidable along the top surface of the cover 1002 is installed on the rail 1003*r*. The door 1003 may slide in a straight line along the rail 1003*r*.

As the door 1003 moves along the rail 1003*r* in the direction indicated by the arrow in FIG. 5, the outside hole 1002*p* and an insertion hole 1004*p* that enable the cigarette 2000 to be inserted into the casing 1100 through the cover 1002 are exposed to the outside. The outside hole 1002*p* of the cover 1002 exposes the insertion hole 1004*p* of an accommodating path 1004*h* for accommodating the cigarette 2000 to the outside.

When the outside hole 1002*p* is exposed to the outside by the door 1003, a user may insert an end portion 2000*b* of the cigarette 2000 into the outside hole 1002*p* and the insertion hole 1004*p*, thereby placing the cigarette 2000 in the accommodating path 1004*h* formed inside the cover 1002.

In the exemplary embodiment shown in FIG. 5, the door 1003 is installed to move in a straight line with respect to the cover 1002. However, the structure in which the door 1003 is coupled with the cover 1002 is not limited thereto. For example, the door 1003 may be rotatably mounted on the cover 1002 through a hinge assembly. In case of employing a hinge assembly, the door 1003 may be rotated along an extension of the top surface of the cover or the door 1003 may be rotated in a direction away from the top surface of the cover 1002.

The rail 1003*r* has a concave groove shape, but the exemplary embodiment is not limited thereto. For example, the rail 1003*r* may have a convex shape or may extend in a curve instead of a straight line.

At the casing 1100, a button 1009 is provided. As the button 1009 is manipulated, the operation of the aerosol generating device 1000 may be controlled.

An outside air introduction gap 1002*g* that allows the air to flow into the interior of the cover 1002 is formed at a portion where the cover 1002 meets the casing 1100 when the cover 1002 is coupled with the casing 1100.

Figure 6:
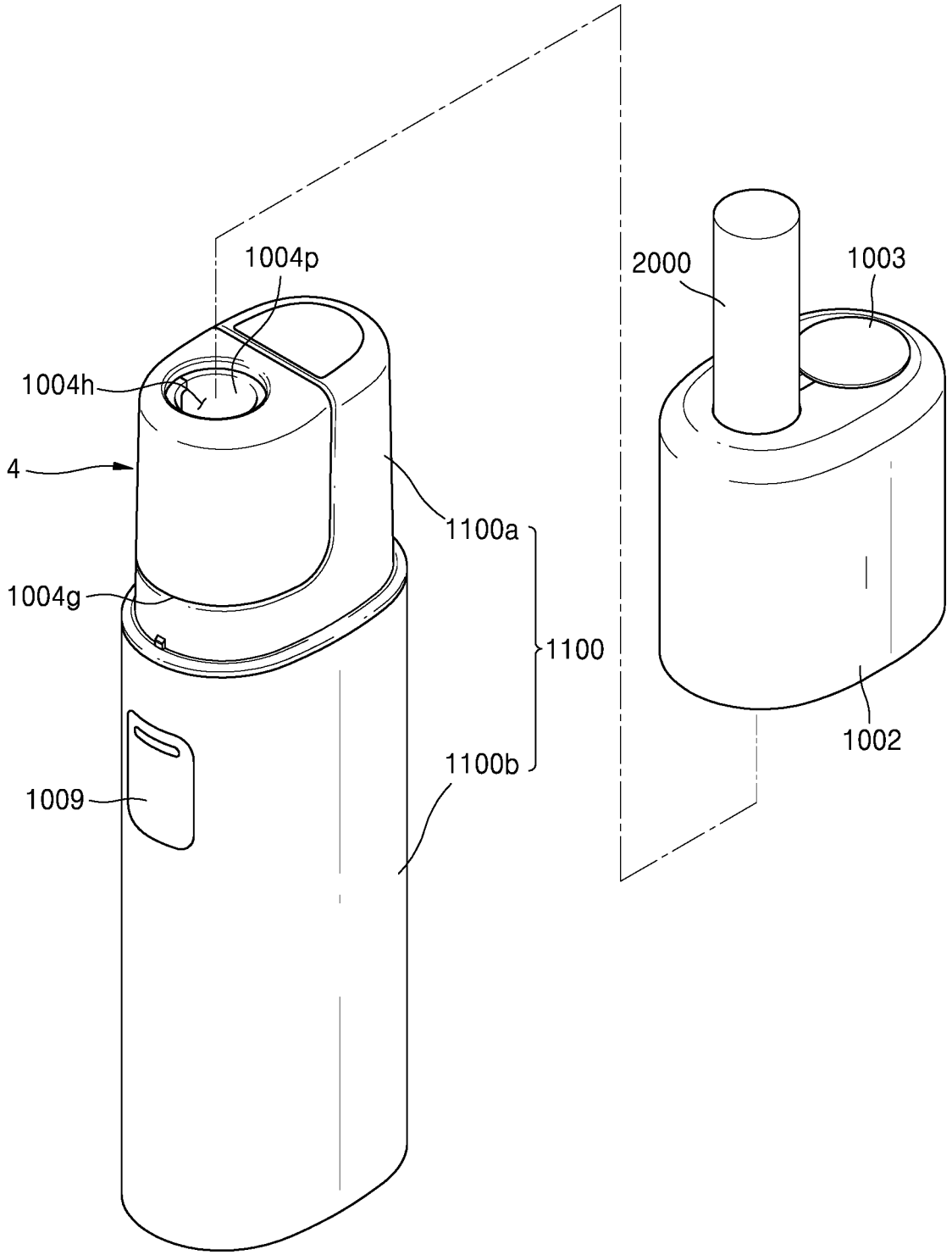
FIG. 6 is a perspective view illustrating an operating state in which some components are separated from the aerosol generating device, according to the exemplary embodiment shown in FIG. 5.

FIG. 6 is a perspective view illustrating an operating state in which some components are separated from the aerosol generating device, according to the exemplary embodiment shown in FIG. 5.

As illustrated in FIG. 6, aerosol may be inhaled by the user holding the cigarette 2000 by mouth while the cigarette 2000 is inserted in the aerosol generating device 1000.

When the cigarette 2000 is finished, the user may remove the cigarette 2000 from the aerosol generating device 1000 and perform a cleaning operation to remove tobacco residue that may remain in the aerosol generating device 1000.

The cleaning operation of the aerosol generating device 1000 may be performed as follows: The user exposes internal space, the heater 1030, and the like of the aerosol generating device 1000 to the outside by separating the cover 1002 from the case 1100 of the aerosol generating device 1000 and separating a cigarette support 4 from the case 1100, so that the tobacco residue may be removed.

In detail, the case 1100 may include an upper case 1100*a* into which the cigarette 2000 is inserted and heated, and a lower case 1100*b* for supporting and protecting the various components installed therein. The case 1100 refers to both the upper case 1100*a* and the lower case 1100*b* hereinafter.

The cover 1002 may be coupled to the case 1100 to cover the cigarette support 4 coupled to the case 1100. Alternatively, the cover 1002 may be separated from the case 1100 if necessary.

After finishing the cigarette 2000, the user may take the cigarette 2000 out of the case 1100 by rotating the cigarette 2000 with a hand to remove the cigarette 2000 from the aerosol generating device 1000.

Alternatively, as illustrated in FIG. 6, when the user rotates the cigarette 2000 and pulls the cover 1002, the cover 1002 may be separated from the case 1100 together with the cigarette 2000, and thus the cigarette 2000 may be removed from the aerosol generating device 1000.

In other words, the cigarette 2000 and the heater 1030 may be decoupled, and at the same time, the tobacco residue attached to the cigarette 2000 may be taken out of the case 1100 together with the cigarette 2000 by rotating the cigarette 2000 and separating it from the case 1100.

When the user pulls the cover 1002 without rotating the cigarette 2000, the cigarette 2000 may be separated from the case 1100 but part of the cigarette, such as tobacco substances, may still remain in the heater 1030. In that case, the user may separate the cover 1002 from the case 1100, and separate the cigarette support 4 from the case 1100. As such, the tobacco substances remaining in the heater 1030 are separated from the case 1100 together with the cigarette support 4. Then, the user may remove the tobacco substances remaining in the cigarette support 4.

Figure 7:
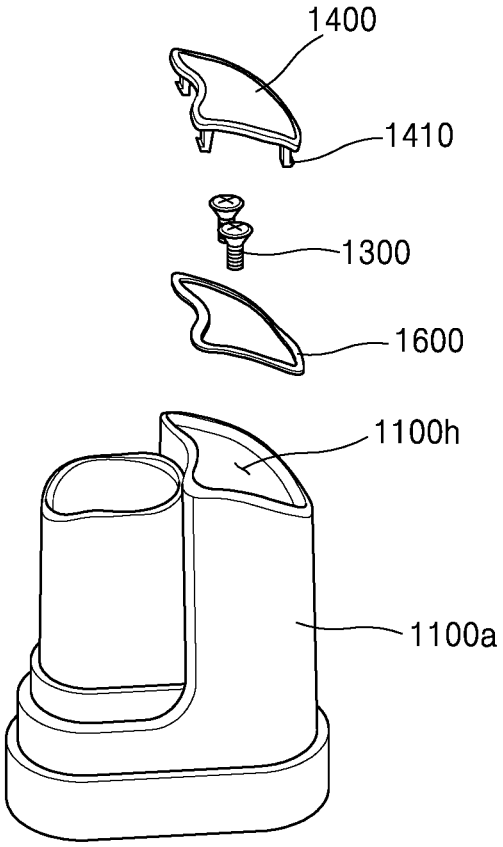
FIG. 7 is an exploded perspective view illustrating some components of the aerosol generating device disassembled, according to the exemplary embodiment shown in FIG. 5.
Figure 8:
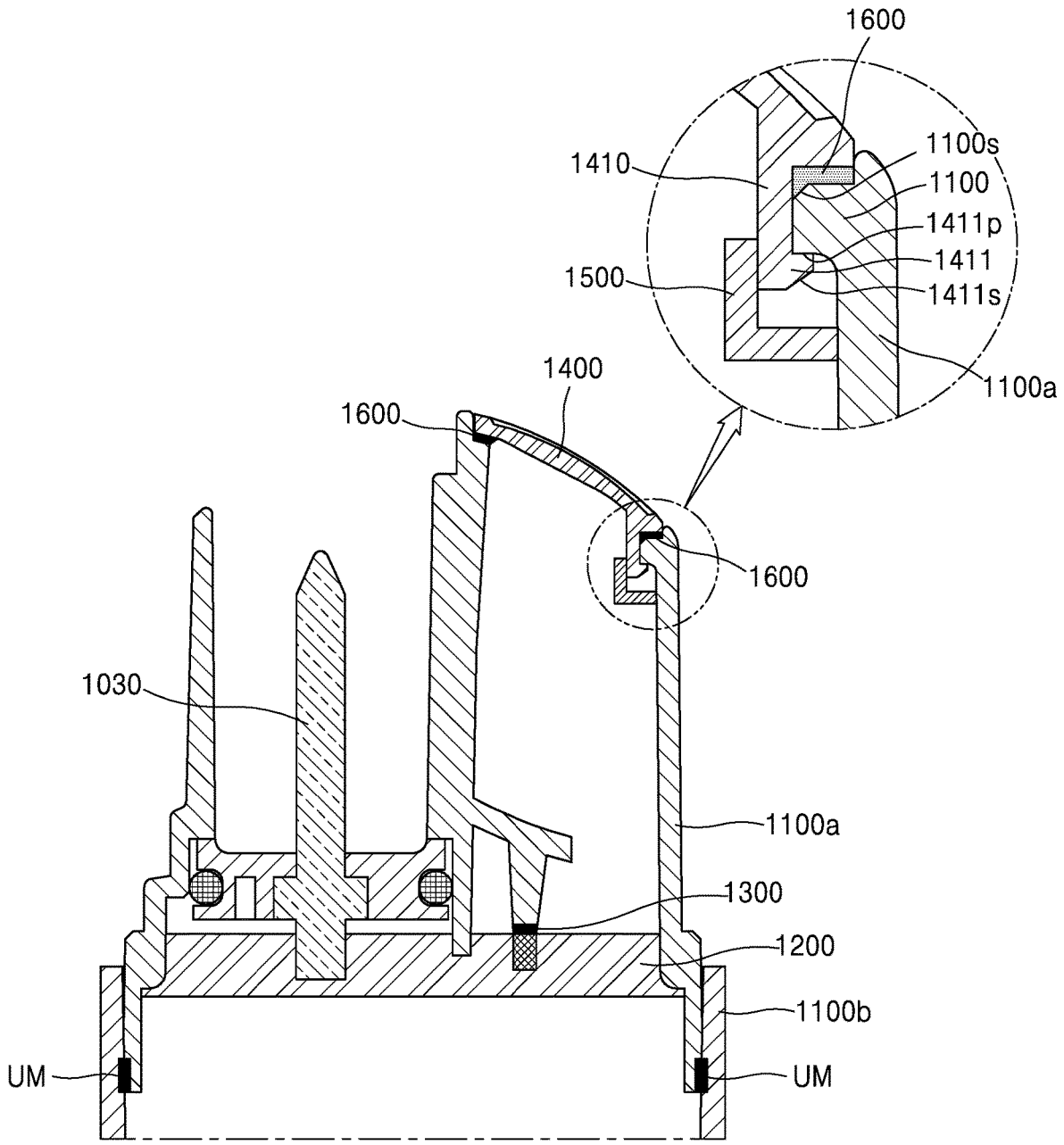
FIG. 8 is a cross-sectional view illustrating a coupling relationship of some components of the aerosol generating device, according to the exemplary embodiment shown in FIG. 5.

FIG. 7 is an exploded perspective view illustrating some components of the aerosol generating device disassembled, according to the exemplary embodiment shown in FIG. 5. FIG. 8 is a cross-sectional view illustrating a coupling relationship of some components of the aerosol generating device, according to the exemplary embodiment shown in FIG. 5.

The aerosol generating device 1000 includes the case 1100, a bracket 1200, a fastening member 1300, and a cap 1400, according to the exemplary embodiments shown in FIGS. 7 and 8.

The heater 1030 may be installed in the case 1100 to heat the cigarette 2000. As described above, the case 1100 may include the upper case 1100*a* and the lower case 1100*b*. The fastening member 1300, the cap 1400, and a sealing member 1600, which will be described later, may be installed in the upper case 1100*a*.

The bracket 1200 may support the various components installed in the case 1100. For example, the bracket 1200 fixes electronic components for supplying power to the heater 1030, such as the battery 1010 and the controller 1020, to the lower case 1100*b* and protects the electronic components.

The fastening member 1300 may fasten the case 1100 and the bracket 1200. It is desirable that the fastening member 1300 may include at least one screw, as shown in FIG. 7. In detail, a screw hole (not shown) into which the fastening member 1300 is inserted may be formed in the case 1100, and a coupling hole (not shown) to which the screw hole is connected may be formed in the bracket 1200. The screw is fastened to the screw hole and the coupling hole by penetrating both the screw hole and the coupling hole. Thus, the case 1100 and the bracket 1200 may be fastened to each other.

The cap 1400 is installed on the outer surface of the case 1100 to conceal the fastening member 1300 in the case 1100 and may be inseparable after installation. Here, the expression 'inseparable after installation' means that the cap 1400 is not easily separated by a general user unless specially manufactured equipment is used. However, exemplary embodiments of the present disclosure are not limited thereto. In addition, the expression 'inseparable after installation' means that the cap 1400 may be separated exceptionally when specially manufactured equipment is used, and also means that, when deformation of any one component or of a plurality of components of the aerosol generating device 1000 like a breakdown of a hook portion 1410 to be described herein below occurs, the cap 1400 may be forcibly separated.

Referring to FIG. 8, the cap 1400 includes the hook portion 1410 protruding in the lengthwise direction of the cigarette 2000, wherein the hook portion 1410 may include a locking jaw 1411 protruding toward the inner surface of the case 1100.

The case 1100 may include a seating portion 1110 protruding toward the hook portion 1410 to seat the cap 1400. When the cap 1400 is installed in the case 1100, the seating portion 1110 may be engaged with the locking jaw 1411, thus restricting upward movement of the cap 1400. For example, surface 1411*p* where the seating portion 1110 and the locking jaw 1411 contact each other may be extended in a direction parallel with the width direction of the cigarette. Given this structure, even when the user arbitrarily lifts the cap 1400 upward, the locking jaw 1411 of the cap 1400 may be caught by the seating portion 1110 of the case 1100, and thus the cap 1400 is unable to move upward.

In addition, the aerosol generating device 1000 may further include a stopper 1500 that is installed on the inner surface of the case 1100. The stopper 1500 presses the hook portion 1410 in the direction in which the locking jaw 1411 protrudes, and thus restricts movement of the hook portion 1410 in the direction in which the seating portion 1110 protrudes. Given this structure, if the user arbitrarily lifts the cap 1400 upward the locking jaw 1411 may be fixed in place by the stopper 1500 and thus prevented from sliding with respect to the seating portion 1110. As a result, the cap 1400 may be prevented from being lifted upward and separated from the case 1100.

The locking jaw 1411 may include an inclined surface 1411*s* which allows the seating portion 1110 to slide while the cap 1400 is installed in the case 1100. The seating portion 1110 may include a sliding surface 1110*s* which allows the locking jaw 1411 to slide while the cap 1400 is installed in the case 1100.

Given this structure, the cap 1400 may be installed in the case 1100 in a convenient and effective manner. In the process of installing the cap 1400 in the case 1100, the inclined surface 1411*s* of the locking jaw 1411 and the sliding surface 1110*s* of the seating portion 1110 slide on each other, and thus the hook portion 1410 of the cap 1400 may be deformed at a certain interval toward the center of the case 1100. Depending on such deformation, the hook portion 1410 may continue to be inserted downward.

After the locking jaw 1411 of the hook portion 1410 is inserted downward further than the seating portion 1110 of the case 1100, the hook portion 1410 returns to its original place, and thus the locking jaw 1411 and the seating portion 1110 may be fitted to each other.

Given the structure as described above, although the cap 1400 may be installed in the case 1100 in a simple manner, the user may not manipulate the cap 1400 arbitrarily or separate the cap 1400 from the case 1100. Since the user is unable to have access to the fastening member 1300 installed in the case 1100, it is impossible for the user to have access to the bracket 1200 fastened to the case 1100 by the fastening member 1300. In addition, since the user is unable to disassemble the aerosol generating device 1000 arbitrarily and have access to various electronic components or the heater 1030 installed therein, problems like burns from the heater 1030 heated to a high temperature and breakdowns of the electronic components due to inadvertent operations may be prevented.

The aerosol generating device 1000 may further include the sealing member 1600 interposed between the case 1100 and the cap 1400 to seal the inside of the case 1100. It is desirable that the sealing member 1600 be made of a material having a certain level of elasticity, like rubber. The sealing member 1600 may prevent the inside of the case 1100 from being contaminated by foreign substances flowing between the case 1100 and the cap 1400.

Interspace between the upper case 1100*a* and the cap 1400, where the sealing member 1600 is installed, and a contact surface UM between the upper case 1100*a* and the lower case 1100*b* may be processed by ultrasonic welding. Exemplary embodiments of the present disclosure are not limited thereto. Additionally, all portions where different components are connected may be joined to each other using ultrasonic welding. In other words, for the purpose of preventing the user from arbitrarily accessing the heater 1030 or the electronic components in the apparatus, all the contact portions needing to be sealed may be joined to each other by ultrasonic welding. Since the portions joined by ultrasonic welding are connected to each other by a rigid body, the user is unable to arbitrarily separate or open the portions unless the user breaks the portions forcibly.

Figure 9:
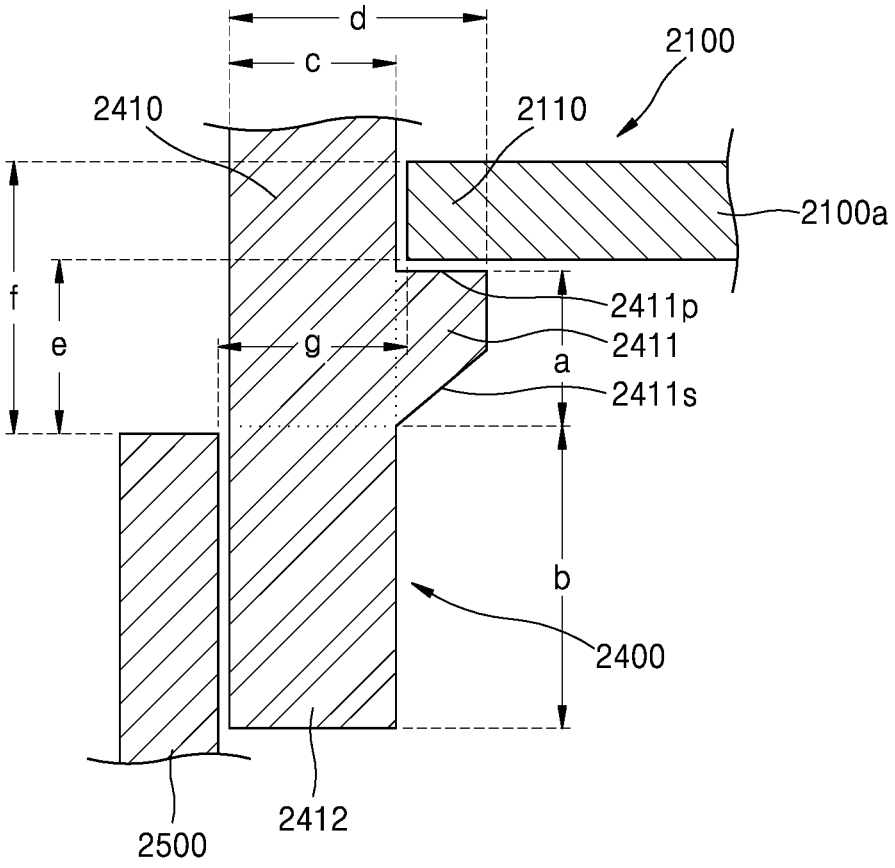
FIG. 9 is a cross-sectional view illustrating a modified example of some components of the aerosol generating device, according to the exemplary embodiment shown in FIG. 8.

FIG. 9 is a cross-sectional view illustrating a modified example of some components of the aerosol generating device shown in FIG. 8.

Referring to FIG. 9, a hook portion 2410 of the aerosol generating device includes an extension member 2412 extending in the lengthwise direction of the cigarette further than a locking jaw 2411. Also, the stopper 2500 may press the extension member 2412 in the direction in which the locking jaw 2411 protrudes.

Given the structure as described above, along the lengthwise direction of the cigarette 2000, length (b) of the extension member 2412 may be greater than distance (f) from the stopper 2500 to the surface where an upper surface of a seating portion 2110 and a cap 2400 contact each other (that is, b>f).

That is because, if the length (b) of the extension member 2412, along the lengthwise direction of the cigarette 2000, is less than or equal to the distance (f) from the stopper 2500 to the surface where the upper surface of the seating portion 2110 and the cap 2400 contact each other (that is, b<=f), in the process of inserting the cap 2400 between the seating portion 2110 and the stopper 2500, the locking jaw 2411 may move to the left by a certain distance, sliding with respect to the seating portion 2110. As a result, the extension member 2412 moves to the left further than the stopper 2500, thus the extension member 2412 may not be inserted into the space between the seating portion 2110 and the stopper 2500.

In addition, along the lengthwise direction of the cigarette 2000, width (a) of the locking jaw 2411 may be less than or equal to distance (e) from the surface 2411*p* where the locking jaw 2411 and the seating portion 2110 engage with each other to the stopper 2500 (that is, a<=e).

That is because, if the width (a) of the locking jaw 2411, along the lengthwise direction of the cigarette 2000, is greater than the distance (e) from the surface 2411*p* where the locking jaw 2411 and the seating portion 2110 engage with each other to the stopper 2500, in the process of inserting the hook portion 2410 between the seating portion 2110 and the stopper 2500, the path where the locking jaw 2411 and the seating portion 2110 slide with each other may be extended, and as a consequence, the seating portion 2110 or the cap 2400 may be damaged.

In addition, along the width direction of the cigarette 2000, width (c) of the hook portion 2410 excluding the locking jaw 2411 may be less than distance (g) from the stopper 2500 to the locking jaw 2411, (that is, c<g).

That is because, when the width (c) of the hook portion 2410 excluding the locking jaw 2411, along the width direction of the cigarette 2000, is greater than or equal to the distance (g) from the stopper 2500 to the locking jaw 2411 (that is, c>=g), the arrangement structure of the hook portion 2410, the seating portion 2110, and the stopper 2500 may not be implemented as shown in FIG. 9. In addition, in the process of inserting the extension member 2412 into the space between the seating portion 2110 and the stopper 2500, the hook portion 2410 may not be upright, and thus the cap 2400 may not be installed in the case 2100.

Also, along the width direction of the cigarette 2000, width (d) of the hook portion 2410 including the locking jaw 2411 may be greater than the distance (g) from the stopper 2500 to the locking jaw 2411, (that is, d>g).

That is because, if the width (d) of the hook portion 2410 including the locking jaw 2411, along the width direction of the cigarette 2000, is less than or equal to the distance (g) from the stopper 2500 to the locking jaw 2411 (that is, d<=g), the hook portion 2410 may easily slip into the space between the seating portion 2110 and the stopper 2500.

While exemplary embodiments of the present disclosure have been illustrated and described in detail with reference to the accompanying drawings, it will be clear that the present disclosure is not limited to these exemplary embodiments only. Numerous modifications, changes, variations, substitutions, and equivalents will be apparent to those skilled in the art. Thus, it is intended that the specification and examples be considered as exemplary only, with the true scope and spirit of the disclosure being indicated by the appended claims.

What is claimed is:

1. An aerosol generating apparatus comprising:

an upper case including an accommodating path capable of accommodating a cigarette;

a cover attachable to an upper side of the upper case and having an outside hole to expose the accommodating path through which the cigarette is inserted;

a heater that heats the cigarette inserted through the accommodating path;

a lower case in which a controller and a battery for supplying power to the heater are installed;

a bracket arranged in the lower case so that at least one of the battery and the controller is supported and accommodated in the lower case;

a fastening member for fastening the upper case and the bracket; and a cap installed on a portion of a top surface of the upper case to conceal components in the upper case, the cap being inseparable from the upper case.

2. The aerosol generating apparatus of claim 1, wherein the upper case includes a first hole, the bracket includes a second hole, and the fastening member fastens the upper case and the bracket by passing through the first hole and the second hole.

3. The aerosol generating apparatus of claim 1 further comprising a sealing member that seals the inside of the upper case.

* * * * *